343-700 MS AU 256 EX
1/17/78 OR 4,069,483

United States Patent [19]

Kaloi

[11] 4,069,483

[45] Jan. 17, 1978

[54] COUPLED FED MAGNETIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[21] Appl. No.: 740,691

[22] Filed: Nov. 10, 1976

[51] Int. Cl.[2] ..... H01Q 00/00; H01Q 1/48

[52] U.S. Cl. ..... 343/700 MS; 343/846

[58] Field of Search ..... 343/700 MS, 846

[56] References Cited

U.S. PATENT DOCUMENTS

| | | | |
|---|---|---|---|
| 3,803,623 | 4/1974 | Charlot, Jr. | 343/700 MS |
| 3,938,161 | 2/1976 | Sanford | 343/846 |
| 3,947,850 | 3/1976 | Kaloi | 343/846 |
| 3,978,487 | 8/1976 | Kaloi | 343/700 MS |
| 3,984,834 | 10/1976 | Kaloi | 343/700 MS |

*Primary Examiner*—Alfred E. Smith

*Assistant Examiner*—Harry Barlow

*Attorney, Agent, or Firm*—Richard S. Sciascia; Joseph M. St. Amand

[57] ABSTRACT

A coupled fed magnetic microstrip dipole antenna consisting of a thin electrically conducting, rectangular-shaped radiating element (resonator) and a nonradiating coupler formed on one surface of a dielectric substrate, the ground plane being on the opposite surface. The radiating element has one end shorted to the ground plane. There is only a single mode of oscillation. Oscillation takes place along the length of the radiating element, and the length determines the resonant frequency. The feed point is normally located at the end of the coupler; energy is in turn coupled to the radiating element. However, the feed point can be located along the uncoupled edge of the coupler. Input impedance matching is determined by a combination of the coupler length and the separation between the coupler and the radiating element, and also the feed location when fed along the uncoupled edge of the coupler.

9 Claims, 9 Drawing Figures

COUPLED FED MAGNETIC MICROSTRIP DIPOLE ANTENNA

CROSS-REFERENCE TO RELATED APPLICATIONS

This invention is related to U.S. Pat. No. 3,978,487 issued Aug. 31, 1976 for COUPLED FED ELECTRIC MICROSTRIP DIPOLE ANTENNA, by Cyril M. Kaloi, and commonly assigned.

This invention is also related to copending U.S. Patent applications:

Ser. No. 740,695 for ASYMMETRICALLY FED MAGNETIC MICROSTRIP DIPOLE ANTENNA;

Ser. No. 740,693 for OFFSET FED MAGNETIC MICROSTRIP DIPOLE ANTENNA;

Ser. No. 740,697 for NOTCH FED MAGNETIC MICROSTRIP DIPOLE ANTENNA;

Ser. No. 740,694 for ELECTRIC MONOMICROSTRIP DIPOLE ANTENNAS;

Ser. No. 740,690 for TWIN ELECTRIC MICROSTRIP DIPOLE ANTENNAS;

Ser. No. 740,696 for NOTCHED/DIAGONALLY FED ELECTRIC MICROSTRIP DIPOLE ANTENNA; and Ser. No. 740,692 for CIRCULARLY POLARIZED ELECTRIC MICROSTRIP ANTENNAS;

all filed together herewith on Nov. 10, 1976 by Cyril M. Kaloi.

The present invention is related to antennas and more particularly to microstrip type antennas, especially low profile microstrip antennas that can also be arrayed to provide near isotropic radiation patterns.

SUMMARY OF THE INVENTION

The present antenna is one of a family of new microstrip antennas. The specific type of microstrip antenna described herein is the "coupled fed magnetic microstrip dipole." Reference is made to the "magnetic microstrip dipole" instead of simply the "microstrip dipole" to differentiate between two basic types; one having the magnetic microstrip type, and the other being the electric microstrip type. The coupled fed magnetic microstrip dipole antenna belongs to the magnetic microstrip type antenna. The magnetic microstrip antenna assembly consists essentially of a conducting strip called the radiating element (resonator), a nonradiating coupler, and a conducting ground plane separated by a dielectric substrate, with the radiating element having one end shorted to the ground plane. The shorting of the radiating element to the ground plane can be accomplished by electroplating through a series of holes or by means of rivets. The length of the radiating element is approximately one-fourth wavelength. The width can be varied depending on the desired electrical characteristics. The conducting ground plane is usually greater in length and width than the radiating element.

The magnetic microstrip antenna's physical properties are somewhat similar to those of the electric microstrip antenna, except that the radiating element is approximately one-fourth wavelength in length whereas the electric microstrip antenna is one-half wavelength in length for the same frequency and the radiating element has one end shorted to ground in the magnetic microstrip antenna. However, the electrical characteristics of the magnetic microstrip antenna are quite different from the electric microstrip antenna, as will be explained hereinafter.

The thickness of the dielectric substrate in the magnetic microstrip antenna should be much less than one-fourth the wavelength. For thickness approaching one-fourth the wavelength, the antenna radiates in a monopole mode in addition to radiating in a microstrip mode.

The antenna as hereinafter described can be used in missiles, aircraft and other type applications where a low physical profile antenna is desired. The antenna structure is readily formed from conductor clad dielectric substrate using conventional photo-etching processes similar to those used in manufacturing printed circuits. The shorts, i.e., rivets or plated-through holes can also be made by techniques used in printed circuits. By arraying the present antenna with several elements, more flexibiity in forming radiation patterns is permitted. In addition, the antenna can be designed for any desired frequency within a limited bandwidth, preferably below 25 GGHz, since the antenna will tend to operate in a hybrid mode (e.g., a microstrip-monopole mode) above 25 GHz for most stripline materials commonly used. For clad materials thinner than 0.031 inch higher frequencies can be used. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.0005 inch for frequencies above 1,000 MHz have been successfully produced. Due to its conformability, this antenna can be applied readily as a wrap around band to a missile body without the need for drilling or injuring the body and without interfering with the aerodynamic design of the missile.

Advantages of the antenna of this invention over other similar appearing types of microstrip antennas is that the present antenna can be fed very easily from the ground plane side with a coaxial-to-microstrip adapter and has a slightly wider bandwidth for the same form factor. The antenna can also be fed from the resonator side, if desired.

The coupled fed magnetic microstrip dipole antenna consists of a thin electrically conducting, rectangular-shaped radiating element (resonator) and a nonradiating coupler formed on the surface of a dielectric substrate; the ground plane is on the opposite surface of the dielectric substrate and the microstrip antenna element is usually fed from a coaxial-to-microstrip adapter, with the center pin of the adapter extending through the ground plane and dielectric substrate to the nonradiating coupler. One end of the resonator is shorted to the ground plane. The length of the antenna radiating element determines the resonant frequency. The feed point is normally located at one end of the coupler; however, other arrangements such as feeding along the uncoupled edge of the coupler is possible. The energy is in turn coupled to the radiating element in the same manner as a directional coupler. The oscillation takes place along the length of the radiating element. Impedance matching is determined by a combination of the coupler length and separation between the coupler element and the resonator element, and also the feed location when fed along the uncoupled edge. The radiation pattern changes very little within the bandwidth of operation.

DESCRIPTION AND OPERATION

Figure 1:
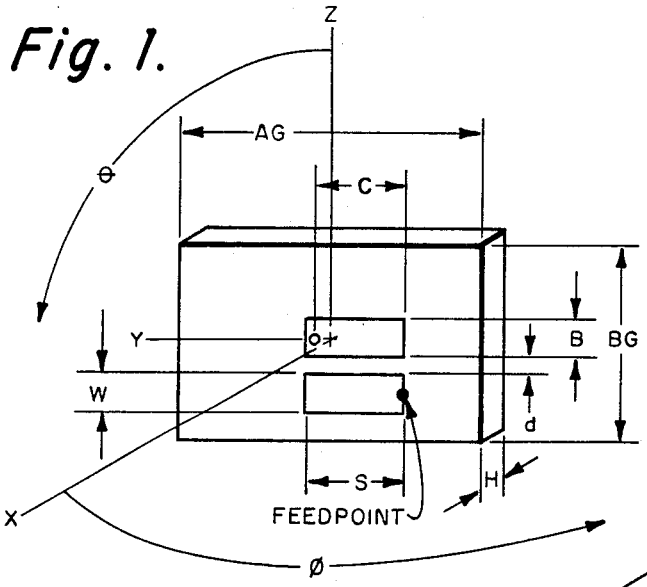
FIG. 1 illustrates the alignment coordinate system used for the coupled fed magnetic microstrip dipole antenna.

The coordinate system used and the aligned of the antenna element within this coordinate system are shown in FIG. 1. The coordinate system is in accordance with the IRIG standards and the alignment of the antenna element was made to coincide with actual antenna radiation patterns that will be discussed later. The antenna is made from copper clad dielectric material. The antenna consists of a radiating element (resonator) and a nonradiating coupler parallel to and spaced apart from the radiating element, and lying in the same plane. One end of the resonator is shorted to the ground plane. The B dimension is the width of the antenna radiating element. The C dimension is the length of the antenna radiating element. The H dimension is the height of the antenna element and antenna coupler above the ground plane and is also the thickness of the dielectric. The W dimension is the width of the coupler. The S dimension is the length of the coupler. The AG dimension and the BG dimension are the length and the width of the ground plane, respectively. The angles $\theta$ and $\phi$ are measured per IRIG standards. The above parameters are measured in inches and degrees.

The length C of the antenna radiating element is that dimension measured from the short (i.e., the center of the rivets or plated-through holes) to the opposite end of the element, as shown in FIG. 1. The number and spacing of the shorting rivets or plated-through holes can be varied without affecting the proper operation of the antenna. More or less shorts than shown in the figures of drawing can be used; the number shown in the drawings, however, operate very satisfactorily. The grounding rivets or plated-through holes used for shorting the radiating element to the ground plane, as shown in the drawings, can be made by techniques used in printed circuits. The size of the rivet or plated-through holes can be varied. However, if the diameter of the rivet or plated-through hole is increased, this will tend to shorten the effective length of the radiating element, thereby increasing the center frequency. Conversely, decreasing the diameter will tend to increase the effective length of the radiating element and thereby decrease the center frequency of the antenna. The short is usually close to the end of the radiating element. As long as the distance between the rivet or plated-through hole and the shorted end of the element strip is a very small fraction of the wavelength, the operation of the antenna will not be afforded.

Figure 2A:
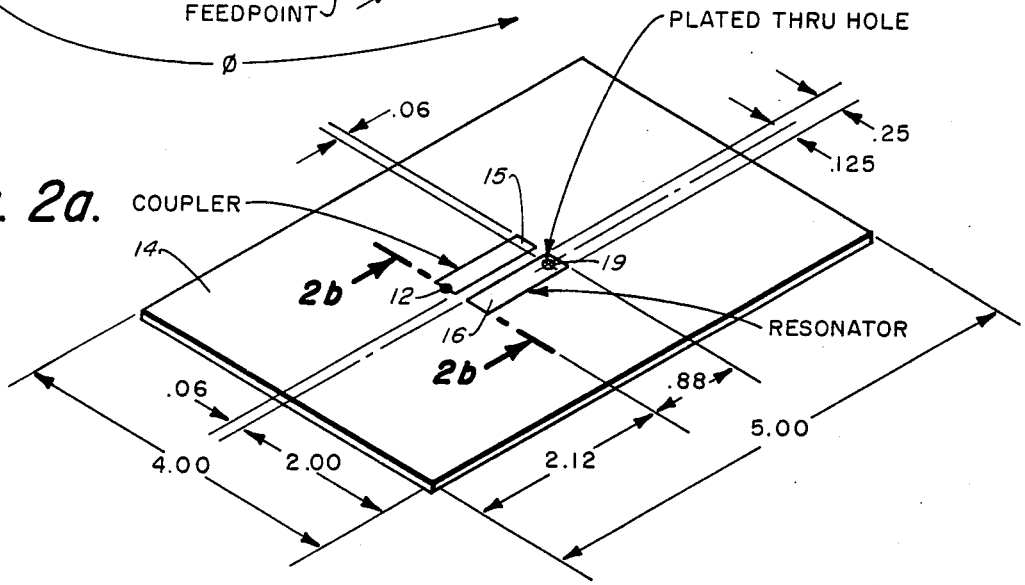
FIG. 2*a* is an isometric planar view of a typical coupled fed magnetic microstrip dipole antenna.
Figure 2B:
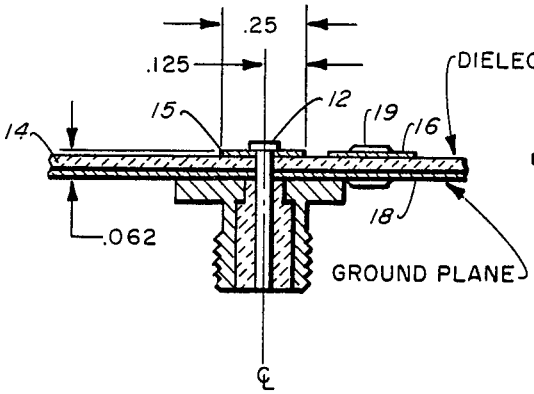
FIG. 2b is a cross-sectional view taken along section line 2*b*–2*b* of FIG. 2*a*.
Figure 3:
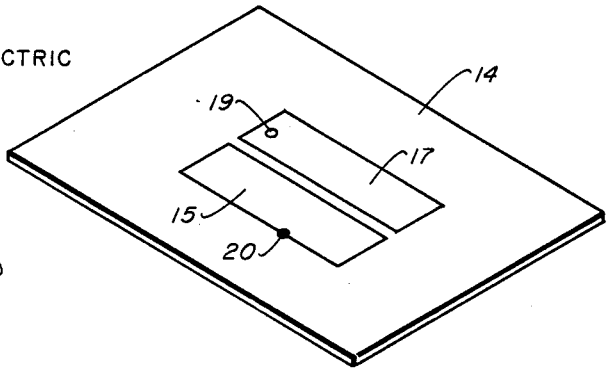
FIG. 3 shows an antenna fed along the uncoupled edge of the coupler element.

FIGS. 2*a* and 2*b* show a typical coupled fed magnetic mocrostrip dipole antenna of the present invention. This antenna is illustrated with the dimensions given in inches as shown by way of example, and curves for the typical antenna illustrated are shown in later figures. The antenna is fed from a coaxial-to-microstrip adapter 10, with the center pin 12 of the adapter extending through the dielectric substrate 14 and connected to the feed point on microstrip coupler 15. Coupler 15 is normally fed on the end. However, other feeding arrangements such as feeding along the uncoupled edge of the coupler is possible. The energy is in turn coupled to the radiating element (i.e., resonator) 16 in the same manner as a directional coupler. The microstrip antenna can be fed with most of the different types of coaxial-to-microstrip launchers presently available. The dielectric substrate 14 separates the element 16 or 17 from the ground plane 18 and one end of the radiating element is shorted to the ground plane by a rivet or plated-through hole 19. In this instance the center of the short is 0.06 inch from the end of the radiating element. The configuration shown in FIGS. 2*a* and 2*b* is very easily resonated and easily matched to most practical impedances. The oscillation takes place along the length of antenna element 16. More control with tuning the input impedance is possible by feeding the coupler element along the uncoupled edge, each as at feed point 20, as shown in FIG. 3.

The antenna is resonated by trimming the C dimension to approximately one-quarter the waveguide wavelength. The impedance matching is determined by a combination of the coupler length "S" and separation (i.e., distance "*d*" in FIG. 1) between the coupler 15 and the resonator 16. An experimental procedure to match the antenna is to choose a separation "*d*" and then trim the coupler 15 until a match occurs. If the separation "*d*" is too wide, a match may not be possible. The selection of the separation width is presently a cut and try process. If the separation width is kept at approximately 0.063 inch or less, a match is possible for most configurations. There are many combinations of the coupler length "S" and the separation width "*d*" to effect a good match.

Figure 4:
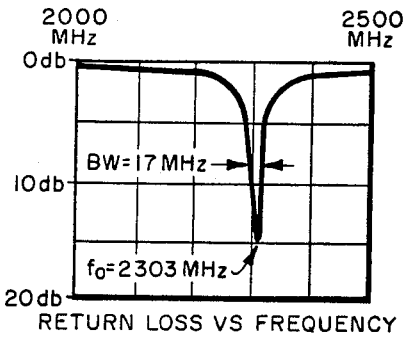
FIG. 4 is a plot showing the return loss versus frequency for a coupled fed antenna having the dimensions shown in FIGS. 2*a* and 2*b*.

FIG. 4 shows a plot of return loss versus frequency for the antenna configuration shown in FIGS. 2*a* and 2*b* having the dimensions given (in inches).

Varying the position of the coupler along the length of the radiating element will vary the antenna electrical characteristics. The copper losses in the clad material determine how narrow the element can be made. The length of the radiating element determines the resonant frequency of the antenna.

It is preferred that both the length and the width of the ground plane be at least one wavelength ($\lambda$) in dimension beyond each edge of the element to minimize backlobe radiation.

Figure 5:
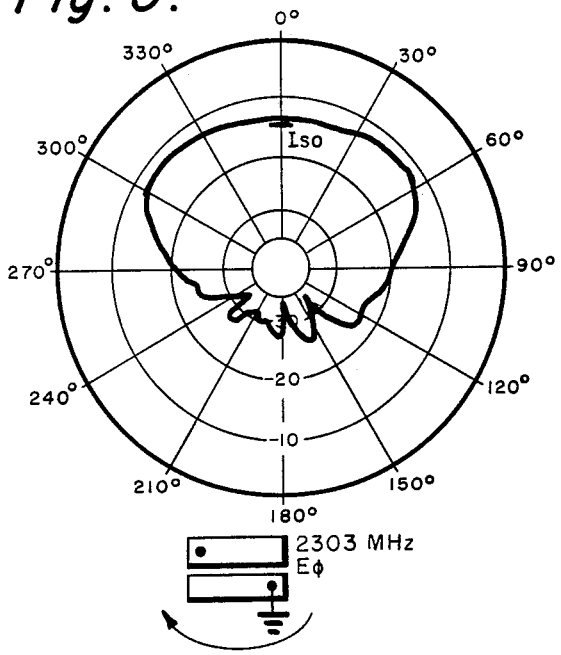
FIG. 5 shows the antenna radiation pattern (XY-Plane plot) for the coupled fed antenna shown in FIGS. 2*a* and 2*b*.
Figure 6:
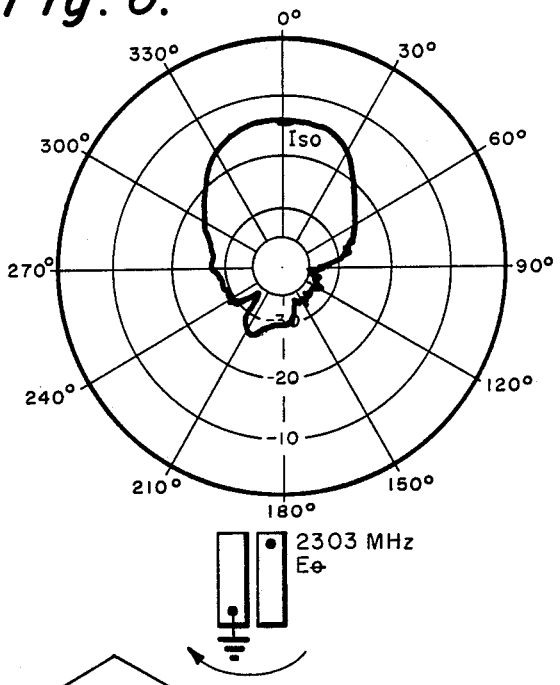
FIG. 6 shows the antenna radiation pattern (XZ-Plane plot) for the coupled fed antenna shown in FIGS. 2*a* and 2*b*.

FIGS. 5 and 6 show antenna radiation patterns for the antenna element of FIGS. 2*a* and 2*b*. Only E-plane (XY-plane) plots and H-plane (XZ-plane) plots are shown. Cross-polarization energy is significant in the XZ plane and minimal in the XY plane. Polarization of the antenna is linear along the length of the antenna. The E-plane plot is the measurement made in the plane parallel to the E field (i.e., polarization field). The H-plane plot is the measurement made normal to the E field. Note that beam width narrowing effects are due to ground plane effects.

The coupled fed magnetic microstrip dipole antenna involves major differences in electrical characteristic when compared to the coupled fed electric microstrip dipole antenna. This is particularly true as to the radiation pattern configurations, such as shown by FIGS. 5 and 6, and for the location of the feed points for different input matching conditions.

Additionally, the coupled fed magnetic microstrip dipole antenna is susceptible to complex polarization which is desirable under certain circumstances. These complex polarization patterns give a half-donut configuration in the XY plane completely around the antenna. Also, in the XY plane there will be a pattern broadside to the element (i.e., above the ground plane).

Figure 7:
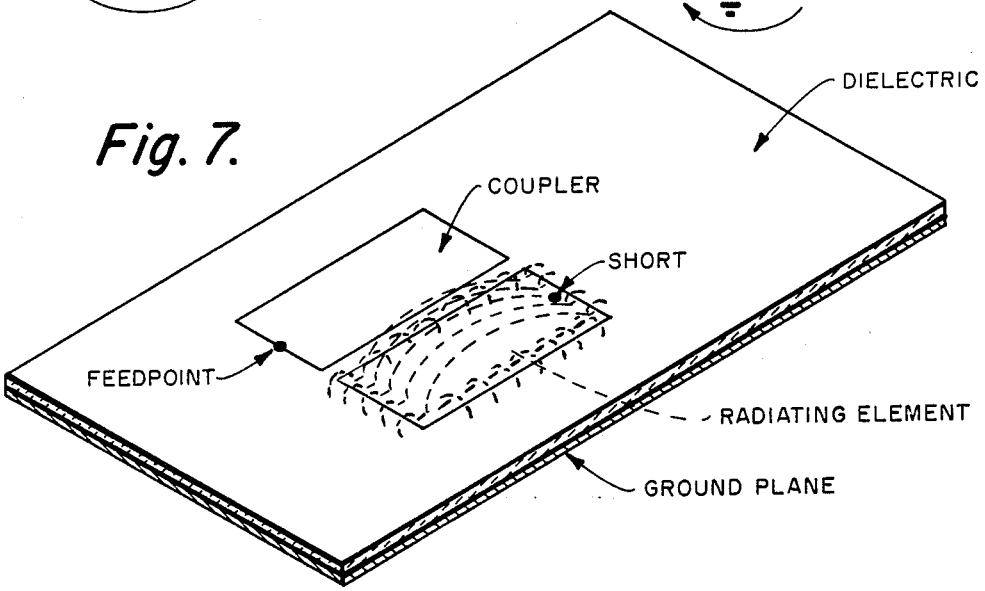
FIG. 7 illustrates the general configuration of the near field radiation of the coupled fed antenna.

A typical near field radiation configuration is shown in FIG. 7 for the typical antenna shown in FIGS. 2*a* and 2*b*. The radiation is vertical along the length of the element with other significant fields from the element to the ground plane around the four edges of the radiating element.

Figure 8:
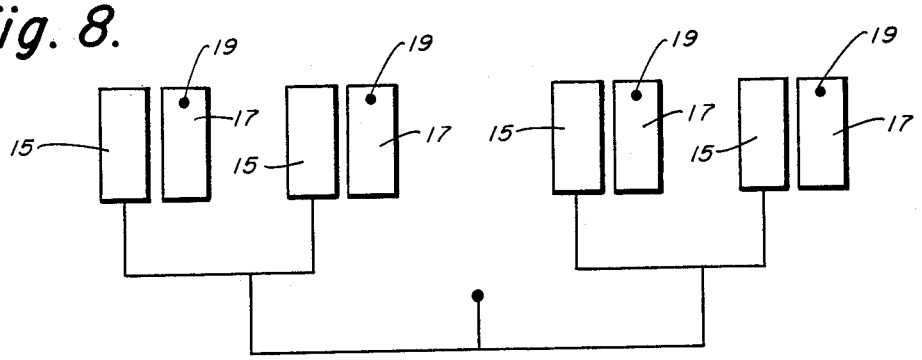
FIG. 8 shows a general arraying configuration, using microstrip transmission line, for a plurality of coupled fed antennas.

A plurality of the antennas can be arrayed as shown in FIG. 8, for example, using microstrip transmission lines which can be etched on the clad material along with the couplers and resonators.

Obviously many modifications and variations of the present invention are possible in light of the above teachings. It is therefore to be understood that within the scope of the appended claims the invention may be practiced otherwise than as specifically described.

What is claimed is:

1. A coupled fed magnetic microstrip dipole antenna having low physical profile and conformal arraying capability, comprising:

a. a thin ground plane conductor;

b. a thin rectangular microstrip radiating element and a separate thin rectangular-shaped microstrip nonradiating coupler alongside and spaced apart from said radiating element;

c. said radiating element and non-radiating coupler being parallel to each other in the same plane and equally spaced from said ground plane;

d. said radiating element and nonradiating coupler being electrically separated from said ground plane by a dielectric substrate;

e. said radiating element being shorted to the ground plane at one end of the length thereof;

f. said nonradiating coupler being fed from a coaxial-to-microstrip adapter, the center pin of said adapter extending through said ground plane and dielectric substrate to a feed point on said nonradiating coupler;

g. the length of said radiating element determining the resonant frequency of said antenna;

h. the antenna input impedance being variable to match most practical impedances by varying any of the coupler length and the distance between said radiating element and said nonradiating coupler without affecting the radiation pattern of the antenna.

2. An antenna as in claim 1 wherein the ground plane conductor extends at least one wavelength in each direction beyond the edges of the said radiating antenna element and said non-radiating coupler to minimize any possible backlobe radiation.

3. An antenna as in claim 1 wherein the feed point of said nonradiating coupler is at one end of the centerline along the length thereof.

4. An antenna as in claim 1 wherein a plurality of said couplers and radiating element are arrayed on one surface of said dielectric substrate.

5. An antenna as in claim 1 wherein the length of said radiating element is approximately one-fourth wavelength.

6. An antenna as in claim 1 wherein the feed point of said nonradiating coupler is along the uncoupled edge of the coupler, which is the edge farthest away from said radiating element.

7. An antenna as in claim 1 wherein said thin rectangular radiating element and coupler are formed on one surface of said dielectric substrate.

8. An antenna as in claim 1 wherein the antenna electrical characteristics are varied by varying the position of said nonradiating coupler alongside the length of said radiating element.

9. An antenna as in claim 1 wherein said radiating element is shorted to the ground plane by means of any of rivets and plated-through holes.

* * * * *